United States Patent [19]

Herschel et al.

[11] 4,403,649

[45] Sep. 13, 1983

[54] OMNI-DIRECTIONAL FACE-AND-BYPASS COIL

[75] Inventors: Ben B. Herschel, Howell; Andrew Chaloka, Clark, both of N.J.

[73] Assignee: Wing Industries, Inc., Cranford, N.J.

[21] Appl. No.: 316,828

[22] Filed: Oct. 30, 1981

[51] Int. Cl.[3] ..... F28F 27/02; F24H 13/04

[52] U.S. Cl. ..... 165/101; 165/103; 165/137

[58] Field of Search ..... 165/98, 99, 101, 103, 165/137

[56] References Cited

U.S. PATENT DOCUMENTS

| | | | |
|---|---|---|---|
| 1,917,042 | 7/1933 | Lewis et al. | 165/176 |
| 3,299,660 | 1/1967 | Sullivan | 165/137 |
| 3,489,204 | 1/1970 | Chaloka | 165/103 X |
| 3,943,995 | 3/1976 | Banko | 165/101 |
| 3,963,070 | 6/1976 | Alley et al. | 165/98 |

FOREIGN PATENT DOCUMENTS

| | | | |
|---|---|---|---|
| 922811 | 4/1963 | United Kingdom | 165/103 |

*Primary Examiner*—Sheldon J. Richte

*Attorney, Agent, or Firm*—Richard C. Woodbridge

[57] ABSTRACT

A face-and-bypass heating coil has features which allow the device to be mounted either horizontally or vertically without loss of mechanical or thermal efficiency. The invention includes a frame comprising a pair of side panels which support the working mechanism, and upper and lower panels. A plurality of fixed partitions are attached between the upper and lower panels. A plurality of movable dampers are mounted on shafts and supported by linear ball bearings such that the movable dampers may selectively mate with the fixed partitions. A crank linkage is used to drive the movable dampers into and away from the fixed partitions. The elastic U-shaped structure of the movable dampers resiliently mates with the fixed partitions so as to form a substantially leak-proof seal around the heating tubes.

5 Claims, 17 Drawing Figures

OMNI-DIRECTIONAL FACE-AND-BYPASS COIL

BACKGROUND OF THE INVENTION

1. Field of the Invention

This invention relates to face-and-bypass coils.

2. Description of the Prior Art

There are a number of references in the prior art to devices which perform as integral face-and-bypass coils. Some of the early experimentation started in Europe. See in particular, French Pat. No. 1,476,716 entitled "Regulation de la Temperature de l'air a la Sortie des Appareils de chauffage et de Conditionment de l'air par un diaphragme Mobile" issued to Mr. Andre Kochmanski on Mar. 6, 1967. FIG. 1 of that reference shows an arrangement including two heat exchangers separated by a by-pass area which serves to make the surfaces of the heat exchangers "transparent" to gas flow. A similar arrangement is also disclosed in Italian Pat. No. 488,648, issued to Ugo Dagnino on Dec. 29, 1953.

British Pat. Nos. 884,540 and 922,811 are relevant in that they appear to disclose linear face-and-bypass apparatus having a single face and single bypass route. Of more relevance is German Offenlegungsschrift No. 1,679,610 which appears to disclose a multiple linear face and multiple bypass channel arrangement.

U.S. Pat. No. 3,943,995 illustrates an integral face-and-bypass arrangement involving multiple movable and fixed dampers. The references cited in the prosecution of U.S. Pat. No. 3,943,995 include the following: U.S. Pat. Nos. 3,034,531; 3,107,724; 3,443,588; 3,522,841; and 3,627,033. In addition the following foreign references were cited: French Pat. No. 1,321,953 and German Pat. No. 1,093,973.

U.S. Pat. No. 827,603 entitled "Ventilator" and issued on July 31, 1906 to J. W. Be Quette et al. discloses a ventilator having relevant structure. An apertured plate is controlled, by translation, to modulate inlet and exit air from a room.

U.S. Pat. No. 2,458,756, issued to C. C. Watson on Jan. 11, 1949, discloses an arrangement for modulating air flow through a heat exchanger.

There are some integral face-and-bypass systems on the market. For example, Flo-Con, 520 North Ave., Garwood, N.J. 07027 produces such a coil which is identified as a FACB in their catalog entitled "FACB-2". The FACB stands for Flo-Con Alternate Coil and Bypass Vertical Tube Coils for Pre-heating and Tempering. Control Air, Inc., 19 Walnut Ave., P.O. Box 917, Clark, N.J. 07066 also produces a face-and-bypass coil identified as the ISOMIX system. That system is identified and described in their catalog literature sheet No. TBS-IX-75. In addition, the Wing Company, a Division of Aero-Flow Dynamics, Inc., Linden, N.J., produces a number of integral face-and-bypass systems which are described in their catalogs IFB-86 and Bulletin VIFB-87. A similar rotary-type face-and-bypass VIFB system is described in detail in U.S. Pat. No. 3,489,204, issued on Jan. 13, 1970 to Mr. A. Chaloka, the co-inventor of the device disclosed in this application.

In view of the foregoing it is clear that the use of single and multiple integral face-and-bypass coils is known in the art. The disclosure that follows describes certain important improvements which make the use of integral face-and-bypass coils substantially more effective and efficient.

SUMMARY OF THE INVENTION

Briefly described the invention comprises an integral face-and-bypass coil which may be mounted either horizontally or vertically without loss of efficiency. The invention is supported by a frame including a pair of side frame panels and upper and lower panels. A plurality of fixed partitions are attached between the upper and lower panels. Heating tubes run adjacent to each of the fixed partitions and extend between the upper and lower panels. Each of the fixed partitions is adapted to mate with a movable damper. The movable dampers are uniquely mounted on shafts which are supported by linear ball bearings mounted in the side frame panels. A crank linkage is used to drive the movable dampers towards and away from the fixed partitions. The elastic U-shaped structure of the movable dampers is especially adapted to permit resilient mating with the fixed partitions in such a way as to form a substantially leakproof seal around the heating tubes. The use of linear ball bearings permits the unit to be mounted either vertically or horizontally. Each of the heating tubes is slightly pitched with respect to the side frames so that condensate that normally accumulates in the tubes can run out if the unit is mounted in the horizontal plane.

The unit also includes several other unusual features. the bottom header "floats" in the frame thereby permitting linear expansion of the finned heating tubing under normal operations. This reduces the stresses imposed on the finned tubing itself and on the brazed header-and-tube joints. It is also possible to easily remove the upper and lower panels of the frame casing as well as the damper support shafts without difficulty. This provides relatively easy access to the header-and-tube area for repair or service without removing the unit from the system.

The linkage design can be driven by a conventional pneumatic or electrical actuator. Such actuation may include spring return to initial position upon removal of air pressure or electrical power. Under those conditions the dampers will automatically return to a "full bypass" or a "full face-pass" position if there is power failure or system shutdown. The option of selecting the ultimate resting position of the movable dampers in case of power failure or system shutdown is exercised simply by relocating the operator's drive link depending upon the required conditions.

These and other features of the invention will be more fully appreciated by referring to the following drawings and detailed description of the invention.

DETAILED DESCRIPTION OF THE DRAWINGS

DETAILED DESCRIPTION OF THE PREFERRED EMBODIMENT

During the course of this description like numbers will be used to identify like elements according to the different figures which illustrate the invention.

Figure 1:
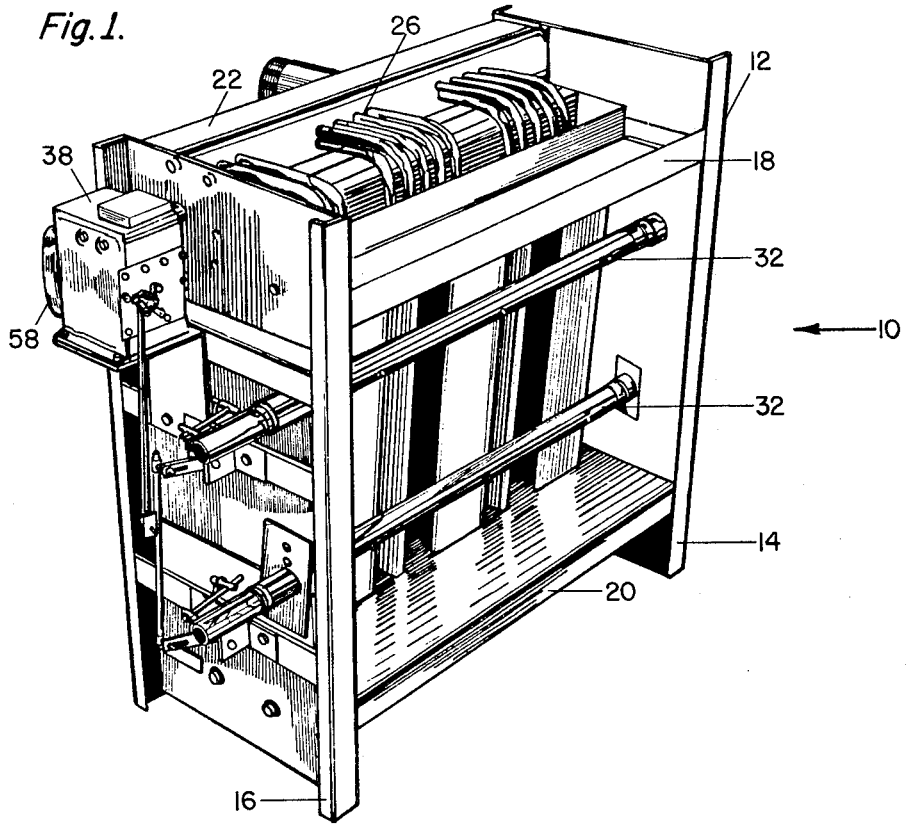
FIG. 1 is a perspective view of the invention showing the crank mechanism and the movable dampers in the half opened position.

The preferred embodiment of the invention 10 is illustrated in perspective view in FIG. 1. The specific model is the U-24-3-2 Unicoil manufactured by NRG Technology, Inc., 601 E. Linden Ave., Linden, N.J. 07036. The elements of the invention 10 are mounted on frame 12 which comprises right and left side panels 14 and 16 and upper and lower panels 18 and 20 respectively. Panels 14, 16, 18 and 20 form a "box" or casing in which the elements of the invention are mounted.

A top header 22 is mounted across the upper portion of side panels 14 and 16. The top header 22 is connected to a floating bottom header 24 through a plurality of heating or cooling tubes 26. Tubes 26 are typically arranged in banks and grouped so as to be as close as possible to fixed partitions 28. Fixed partitions 28 are rigidly connected to upper and lower panels 18 and 20 respectively. Movable dampers 30 are mounted in such as way as to selectively mate with fixed partitions 28.

Figure 8:
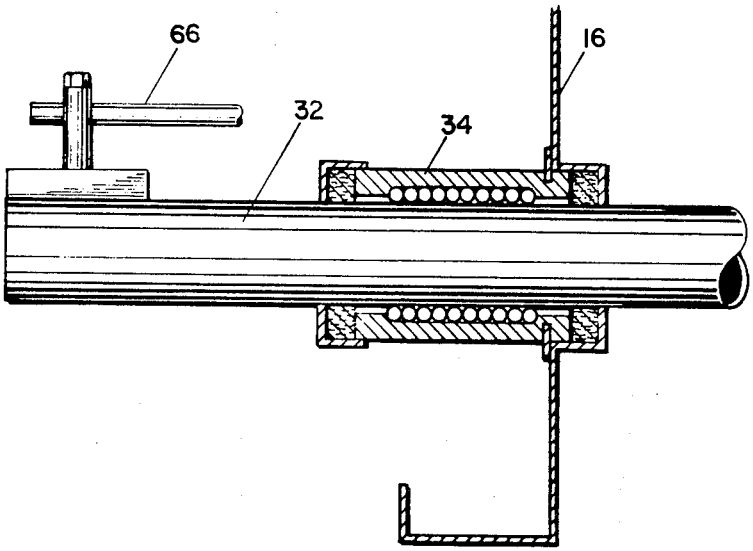
FIG. 8 is a detailed partial cross-sectional view showing the linear ball bearing structure which supports the movable dampers.
Figure 9:
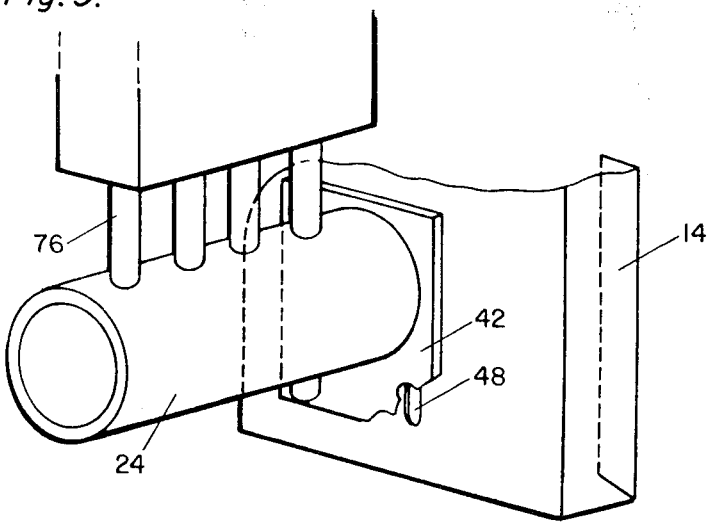
FIG. 9 is a partial cross-sectional view showing the manner in which the bottom header is mounted with respect to the side panels of the frame so that it floats with respect thereto.

Movable dampers 30 are mounted on a pair of movable shafts 32 which are each supported by two linear ball bearings 34 in the manner shown in detail in FIG. 8. Damper shafts 32 are moved by linkage mechanism 36 which includes in this case an electrical rotary operation 38 and a crank lever 60. Therefore, actuation of electrical motor 38 causes the movable dampers 30 to move towards or away from fixed partitions 28.

Each end of bottom header 24 is attached to an end plate 42. Plate 42 is mounted to side panels 14 and 16 by a pair of captive nuts and bolts 44 and 46 respectively. Bolts 46 pass through slots 48 in side panels 14 and 16 and are secured in that position by captive nuts 44 as previously described. This arrangement allows the bottom header to move or "float" as tubes 26 expand and contract. It also permits linear expansion of the finned tubing 26 under normal operation, without undue stresses being imposed on the tubing 26 or on the brazed header-and-tube joints. Similarly one set of linear ball bearings 34 is mounted on an adjustable sliding plate 40 to allow for the expansion of movable dampers 30 and the consequent realignment of shafts 32.

Figure 7:
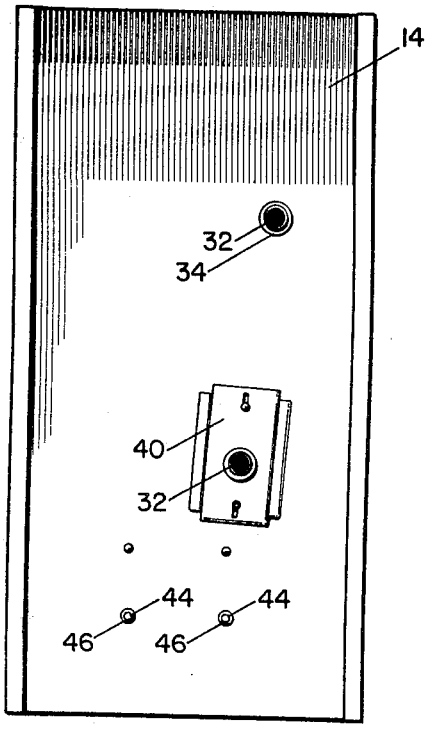
FIG. 7 is a left side elevational view of the invention showing the left side panel of the frame.
Figure 10A:
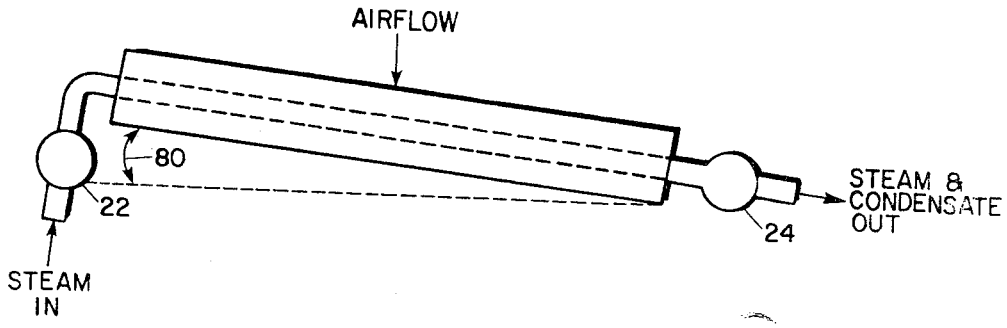
FIG. 10A illustrates the manner in which a single row of steam tubes is slightly pitched so as to provide for the removal of condensate when arranged for vertical airflow.

The linear ball bearings 34 permit the invention 10 to be mounted either in the vertical position or in the horizontal position (as may be the case with a roof mounting). Almost any position between the vertical and horizontal position would be possible too given the unique nature of the suspension of the movable dampers. This additional capability was not believed to be practical with prior art face-and-bypass coils due to their restrictive baffle support structure. A consequence of being able to mount the invention 10 horizontally is that there may be a tendency for condensate water to collect in the tubes. In order to overcome this problem the present invention provides for off-setting or "pitching" tubes 26 so that condensate will normally run out when the unit 10 is mounted in the horizontal position. FIG. 10A illustrates the manner in which steam coil tubing is pitched to provide for condensate runoff. This feature may also be appreciated by viewing the unit 10 from the side as shown in FIG. 7. Note that lower damper support shafts 32 are offset from upper shafts 32 by approximately 1½". The amount of offset 80 varies from approximately 3° 35′ for smaller models of the invention 10 to 1° 3′ for larger models. The concept of offsetting the finned tubing 26 is believed to be unique in the context of face-and-bypass coils since the concept was introduced as a consequence of inventing a face-and-bypass coil which is omni-directional wih regard to mounting.

Each of the fixed partitions 28 includes a front edge 50, a rear edge 52 and a mixing baffle 54 attached to rear edge 52. Front edge 50 and rear edge 52 comprise flanges tapered inwardly towards each other as illustrated in cross-sectional views of FIGS. 4A–4C. The mixing baffle 54 is mounted right on the trailing edge of each fixed partition 28 and serves to divert air across the adjacent stream.

Figure 4A:
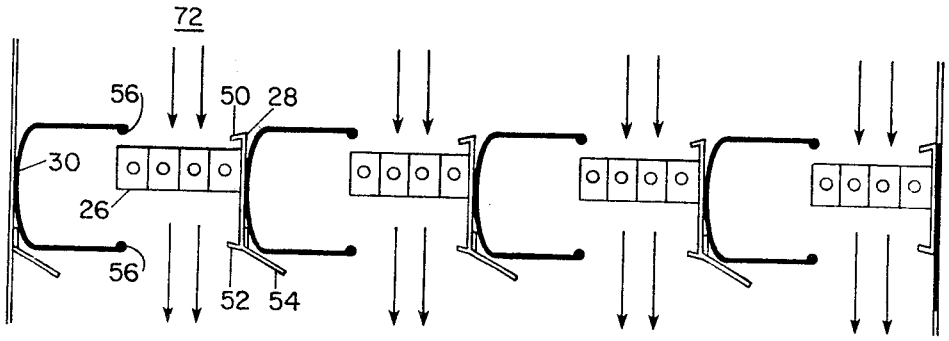
FIG. 4A is a cross-sectional view of the invention showing the device in the full face-pass mode.
Figure 4B:
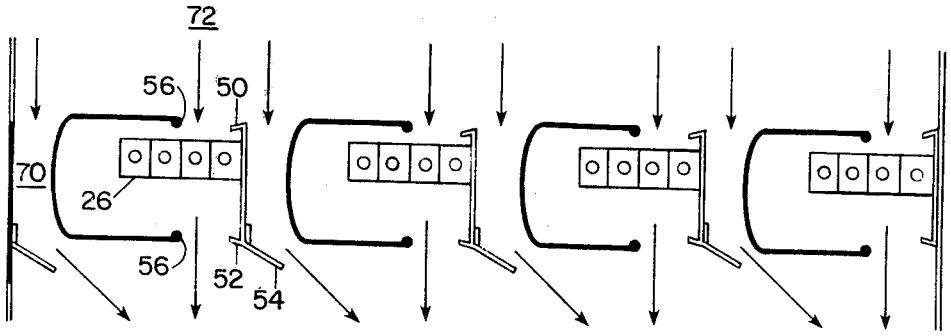
FIG. 4B is another cross-sectional view of the invention showing the device in the partial face-pass/partial bypass mode.
Figure 4C:
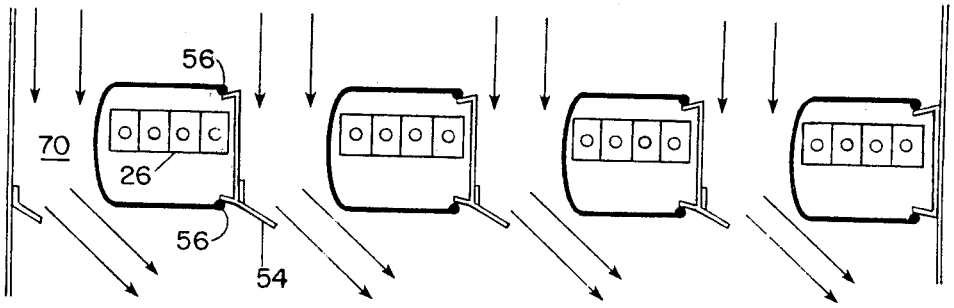
FIG. 4C is another cross-sectional view of the invention showing the device in the full bypass mode.
Figure 5:
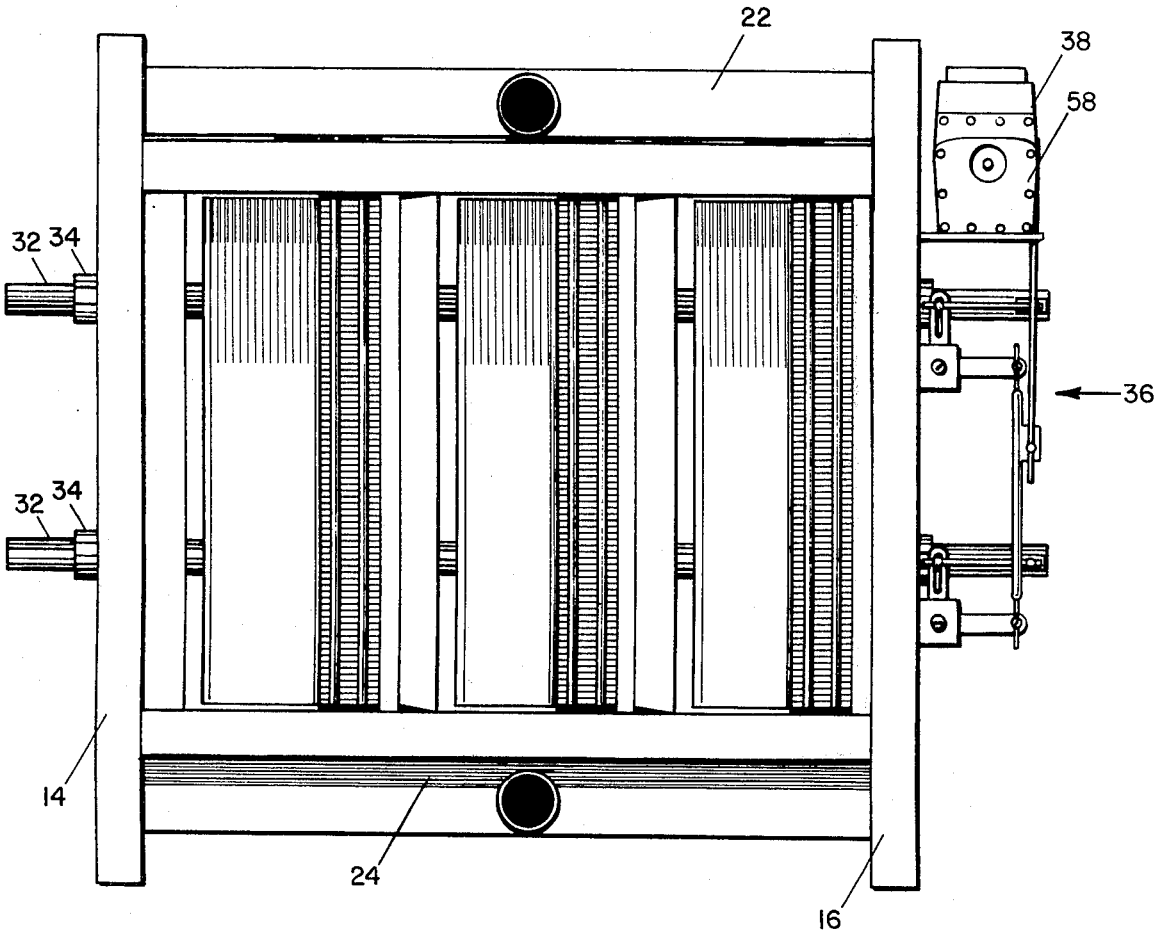
FIG. 5 is a back elevational view of the invention showing the device in the partial face-pass/partial bypass mode.
Figure 6:
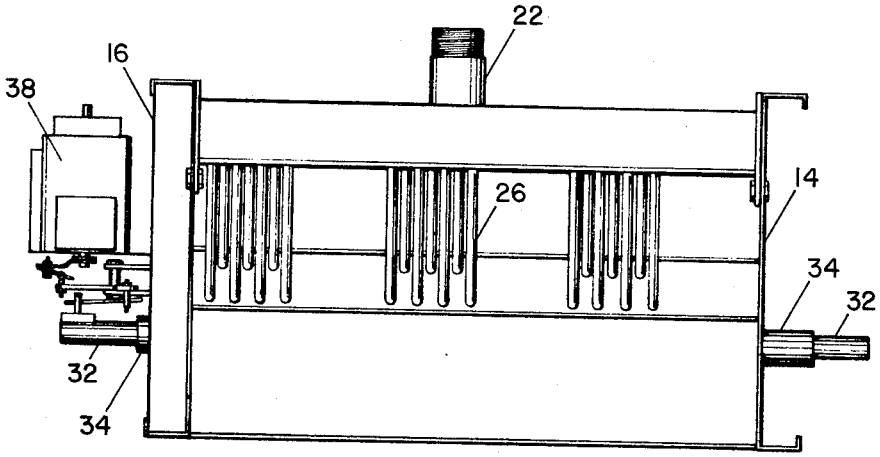
FIG. 6 is a top plan view of the invention showing the device in the partial face pass/partial bypass mode.

Each movable damper 30 has a generally U-shaped profile as also illustrated in FIGS. 4A–4C. The two arms of the movable damper 30 terminate in smooth rounded beads 56. Beaded edges 56 are adapted to mate with the front and rear flanges 50 and 52 of the fixed partitions 28 in such a manner as to effect a substantially leak-proof seal. A leak-proof seal is accomplished because the arms of the movable dampers 30 are flexible and elastic. When beads 56 mate with flanges 50 and 52, they tend to form a resilient jam-fit through which outside air cannot pass. During the course of the jam-fit the beads 56 ride up on flanges 50 and 52 causing the arms of the movable dampers 30 to be cammed slightly away from each other. In order to accomplish a truly effective seal the fixed partitions 28 are mounted on upper and lower panels 18 and 20 by nuts and bolts in such a fashion that small adjustments in position are possible. This allows each fixed partition 28 to be positioned at the optimal location with respect to movable dampers 30 so that the best possible leak-proof seal is formed when the device is operating in the full bypass mode. This adjustment capability also is believed to be unique in the context of face-and-bypass coils.

The structure of the linkage mechanism 36 affords substantial flexibility of application while eliminating the need for modifications or additional linkages to interface with different types of actuators. Linear actuators such as pneumatic damper operators may be applied directly to the inter-connecting link between the damper support shafts 32. In cases where rotary actuation (i.e. electric damper operators) is required, the present damper linkage 36 offers additional flexibility. When used with spring return operators, a change from "full bypass" to "full face pass" upon power failure is accomplished simply by relocating the operator's drive link to the required position on the inter-connecting link. The return spring 58 may be internal and integral with the actuator 38 or it might be external and attached to the linkage mechanism 36. According to the preferred embodiment the linkage mechanism 36 includes a lever 60 attached to a drive link 62 which in turn is connected to a common link 64 which actuates upper and lower cranks 66 and 68 respectively. Cranks 66 and 68 are connected to damper shafts 32. The electrical actuator 38 causes lever 60 to move in a rotary fashion. The rotary motion is translated into linear motion by the links 62 and 64 and upper and lower cranks 66 and 68.

Actuator 38 could also be pneumatic or hydraulic under the appropriate circumstances. While a rotary actuator 38 has been illustrated, it is very possible to use linear actuators in the manner previously described.

Another advantage of the present invention 10 is that the device is relatively easy to service in the field. The frame 12 is constructed so that upper and lower panels 18 and 20 as well as shafts 32 can be readily removed for access to the headers 22 and 24 and tube assembly 26 without removing the entire frame 12 from the system. Therefore, repairs and routine maintenance can be accomplished on the tubes 26 without taking the entire unit 10 out of its mounting environment.

The movable damper shafts 32 utilize four linear ball bearings 34 to accomplish the required smooth operation of the assembly. The coefficient of friction of the linear ball bearings compares favorably to that of radial ball bearings ($\mu=0.002-0.003$), and the resultant operating force required to move dampers 30 is minimal. The damper support shafts 32 serve as the inner face for the bearings, resulting in a movement and operation unequaled by existing alternative methods.

The operation of the invention 10 will be appreciated by reviewing FIGS. 2A–2C, 3A–3C and 4A–4C.

Figure 2A:
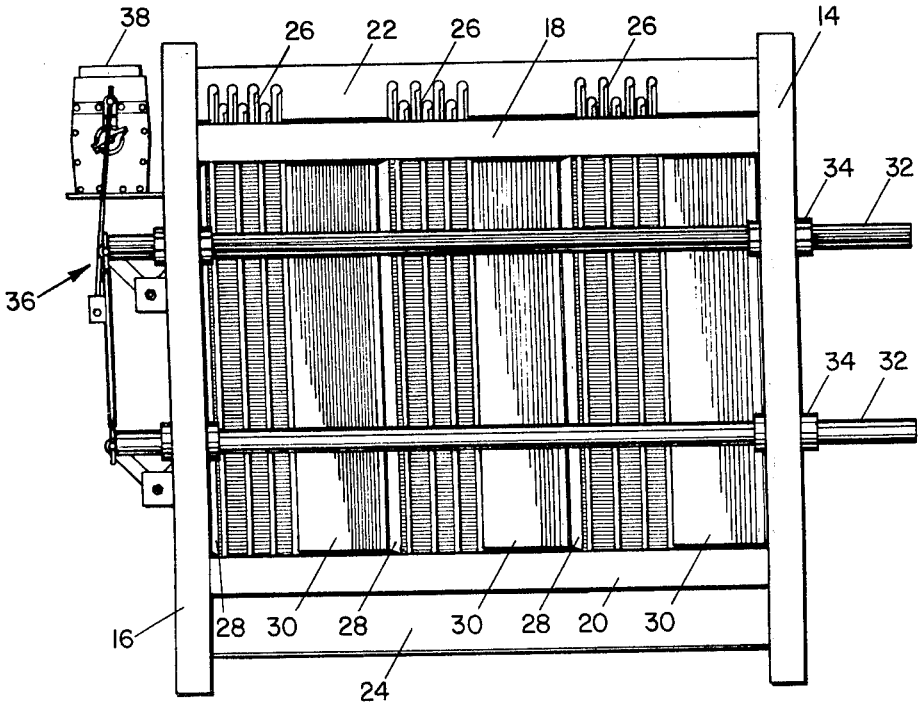
FIG. 2A is a front elevational view of the invention showing the device in the full face-pass mode.
Figure 3C:
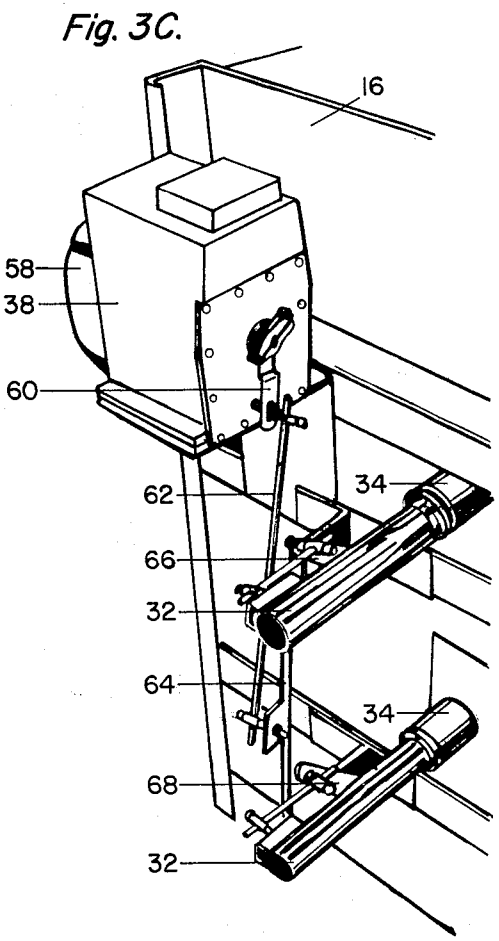
FIG. 3C is a side elevational view of the crank mechanism shown in the full bypass position.
Figure 3B:
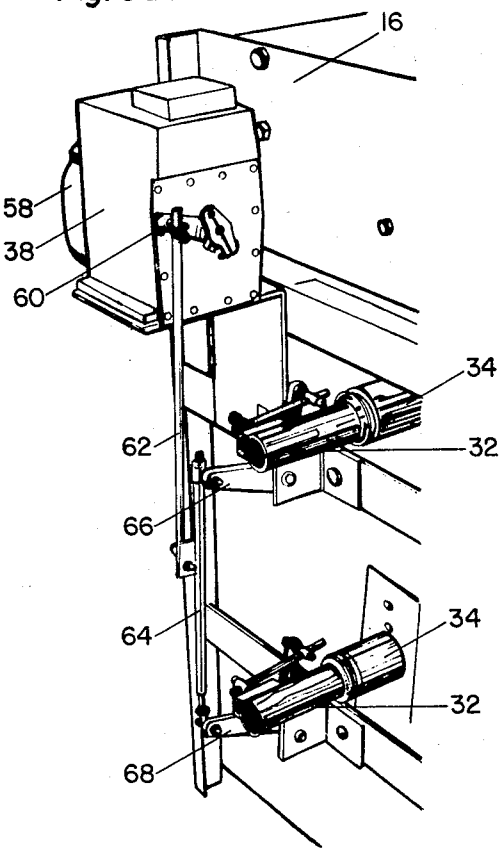
FIG. 3B is a side elevational view of the invention showing the crank mechanism in the partial face-pass/-partial bypass position.
Figure 3A:
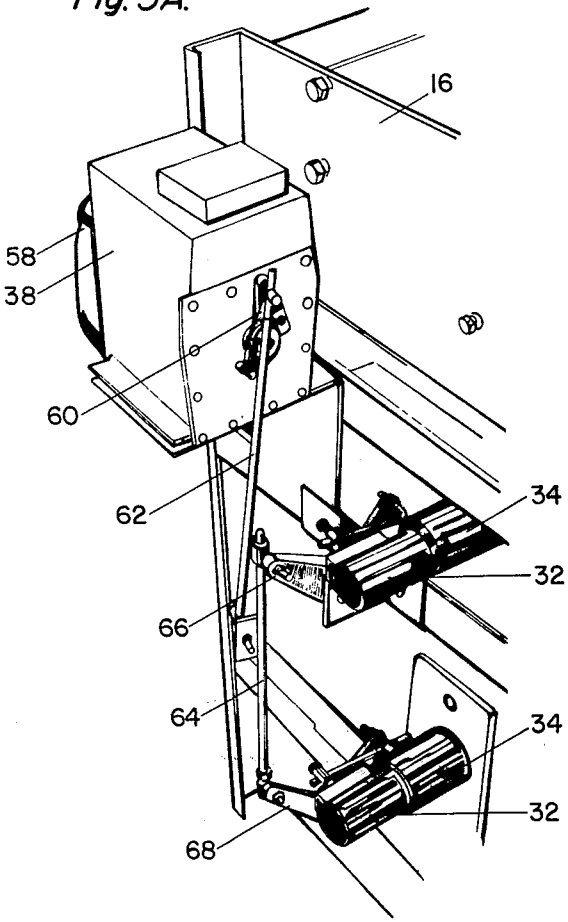
FIG. 3A is a side elevational view of the unit showing the crank mechanism in the full face-pass position.

FIGS. 2A, 3A and 4A illustrate various aspects of the invention in the full face-pass mode. This might be the mode employed when the outside temperature is 0° F. At that temperature the movable dampers 30 fully block the bypass channels 70, directing all of the entering air through face-pass channels 72 and across the heating surfaces of finned tubes 26. Under these circumstances the heated air after passing over tubes 26 might be raised to 55° F., for example.

Figure 2B:
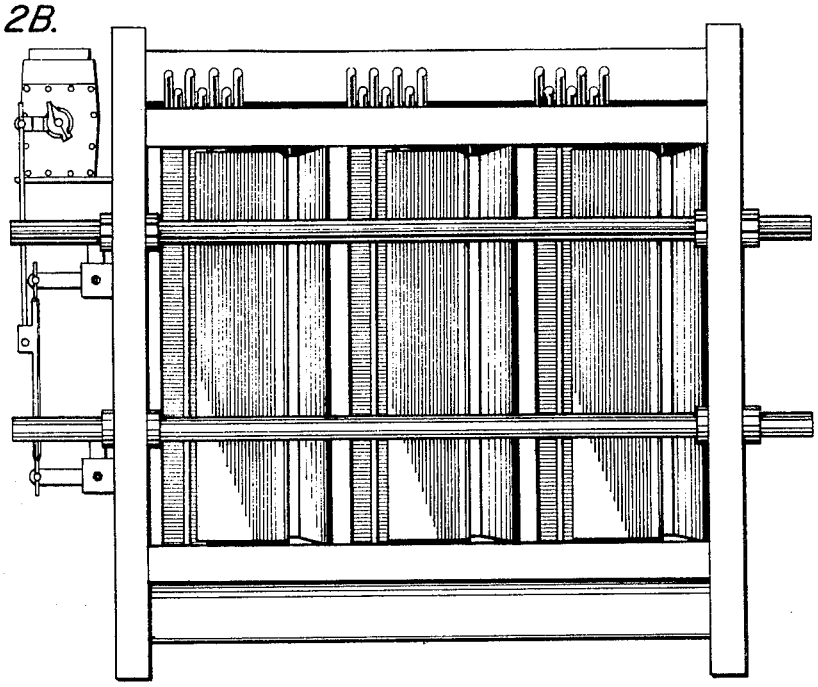
FIG. 2B is a front elevational view of the invention showing the unit in the partial face-pass/partial bypass mode.

If the outside temperature is relatively moderate (e.g. 30° F.) then the invention 10 might modulate to the partial face-pass/partial bypass mode as illustrated in FIGS. 2B, 3B and 4B. At 30° F. the damper assembly modulates to allow air to be proportioned through both the heating and bypass channels, 72 and 70 respectively, of the unit 10. Mixing baffle 54 serves to divert the bypass air into the heated air stream thereby providing improved uniformity of output temperature. Under the temperature circumstances described the outside 30° F. air might be raised to 55° F. after passing through the unit 10.

Figure 2C:
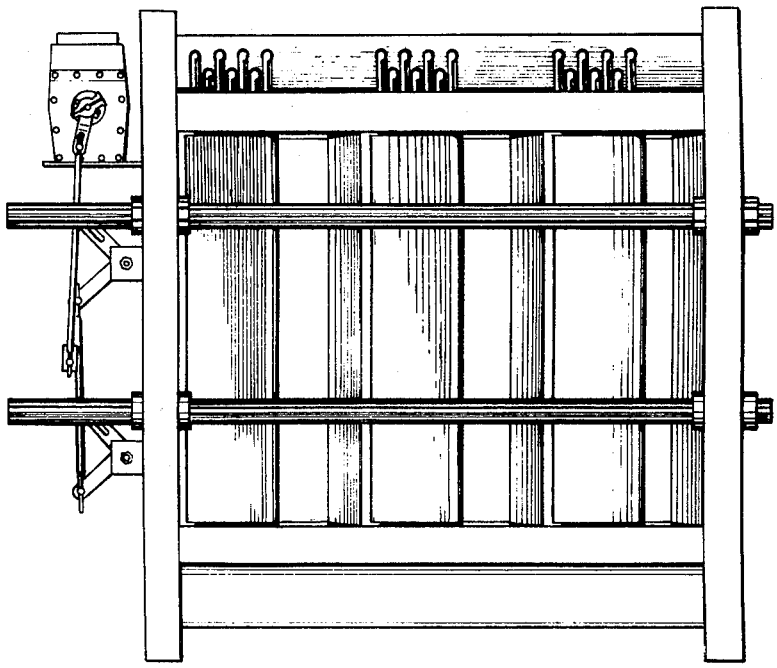
FIG. 2C is a front elevation of the unit showing the device in the full bypass mode.

If a minimum temperature rise is required, then the unit 10 might modulate to the full bypass mode as illustrated in FIGS. 2C, 3C and 4C. For example, at 55° F., the dampers 30 have fully blocked the finned tubes 26 thereby directing all of the air through the bypass channels 70. Because of the heat radiated by movable dampers 30 there will be a slight rise in temperature. For example if the outside air is 55° F., the air that passes through the unit 10 might rise to 57° F.

The operation of the invention 10 as illustrated in FIGS. 2A, 2C, 3A, 3C and 4A, 4C, has a number of important advantages over typical prior art systems. Offset tubes 26 cause steam condensate to flow rapidly into the return header. The movable dampers 30 mate with their respective fixed partitions 28 in a sliding fit when full bypass operation is required. This eliminates the possibility of air heat pick-up (i.e. temperature override) due to unwanted air leakage through the heating channel 72. In prior art coils there was frequently a tendency to freeze up due to uneven heating of the incoming air. In addition, temperature oscillations were possible if a substantially complete seal was not obtained. In invention 10, the mixing and diverting baffles 54 force the cold bypass air to mix within three feet of the downstream face of unit 10. This minimizes temperature stratification and maximizes uniformity of downstream conditions. The diverting baffle 54 is also very important because it imposes a pressure drop on the bypass air in inverse proportion to the pressure drop experienced by the air passing through tubes 26. Therefore the pressure drop across the unit 10 always stays substantially the same regardless of the amount of face-pass or bypass exposure. This feature is important in order to maintain constant system airflow volume. Without the presence of baffle 54, unequal volumes of airflow due to changes in damper opening position, would have the tendency to unbalance the entire heating system.

Bearing shafts 32 and dampers 30 are preferably made of aluminum or stainless steel. Bearing shafts 32 tend to work harden with use along the paths of ball travel. Linear ball bearings such as those described as elements 34 also have the advantage of being self-cleaning; that is to say, the bearings 34 tend to push dirt out of the path traversed by the ball circuits during the course of their travel. The foregoing structure allows the dampers 30 to move smoothly throughout their entire travel with a minimum of friction or restraining forces. Therefore it is possible to use an actuator 38 of relatively small size.

Figure 10B:
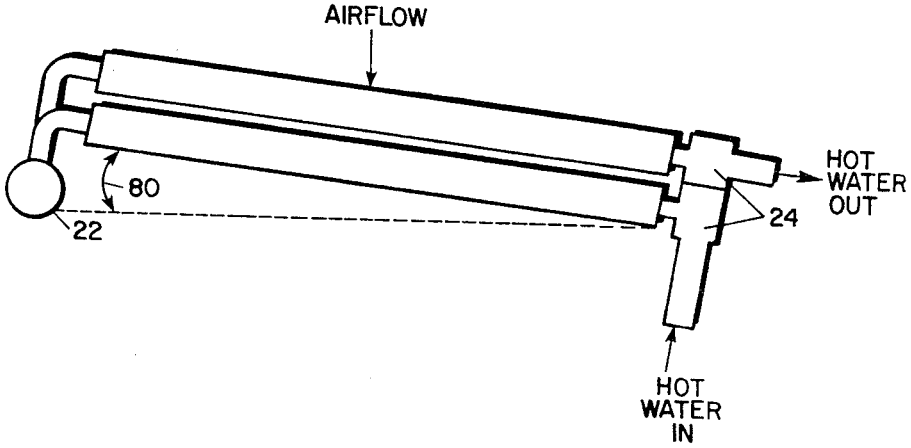
FIG. 10B illustrates a plurality of hot water tubes arranged so as to provide for counterflow of the heating medium.

The basic invention described can be applied to integral face-and-bypass coils of different sizes. The present device is offered in seventy sizes up to 71.6 sq. ft. outlet area. The device is typically used with one- and two-row steam tubing as shown in FIG. 10A or two-row hot water tubing, as shown in FIG. 10B. The damper actuator 38 and the associated linkage mechanism 36 is shown mounted on the left hand side of the machine (looking into the direction of air flow). Right hand damper mounting is also possible.

While the invention has been described with reference to the preferred embodiment thereof, it will be appreciated by those of ordinary skill in the art that various changes may be made to the operation or elements of the invention without departing from the spirit and scope thereof.

We claim:

1. A face-and-bypass coil apparatus comprising:

a frame including a pair of side panels, at least one upper panel attached to said side panels, and at least one lower panel also attached to said side panels and located on a portion of said side panels removed from said upper panel;

heating tubes pitched from between 1° and 3° with respect to the long axis of said side panels in order to avoid the accumulation of condensation within said heating tubes when said apparatus is mounted in a subsantially horizontal mode;

a top header attached to one end of said heating tubes;

a bottom header attached to the other end of said heating tubes;

movable means for attaching said bottom header to said frame so that said header floats and is free to respond to thermal expansions and contractions of said heating tubes;

fixed partition means connected to and extending between said upper and lower panels, said fixed partition means including a pair of flanges located on the leading and trailing edge of said partition means, said flanges facing towards said heating tubes and being slightly inclined towards each other;

movable damper means including a plurality of U-shaped damper means having two arms on opposite sides thereof, said two arms being resiliently related to each other in such a way that they respectively impinge upon the flanges of said fixed partition means in a sliding fit thereby camming said resilient arms of said movable damper means away from each other and forming a resilient compression seal with respect to said fixed partitions to substantially completely block off air which otherwise might base over said heating tubes;

mounting means for supporting said movable damper means so that said face-and-bypass coil can be installed in substantially any orientation ranging from vertical to horizontal with respect to gravity, said mounting means including linear ballbearing means attached to said frame and shaft means attached to said movable damper means, said shaft means being surrounded by said linear ballbearing means;

means for moving said movable damper means; and, mixing and diverting baffle means attached to the trailing edge of said fixed partitions for improving the mix of bypass air with face-pass air and for equalizing system air flow volume with changes in damper opening position.

2. The apparatus of claim 1 further comprising:

floating means attached to said bottom header and to said side panels for allowing said bottom header to automatically adjust to the thermal expansion and contraction of said heating tubes during their heating cycle.

3. The apparatus of claim 2 further including:

actuator means for providing movement to said movable dampers; and, linkage means attached between said actuator means and said shaft means for transmitting motion from said actuator means to said movable dampers.

4. The apparatus of claim 3 further including:

means for returning said movable dampers to a predetermined position in the event of a power failure in said actuator means; and, means for pre-selecting said pre-determined position.

5. The apparatus of claim 4 further including:

adjustable means attached to at least two linear ball bearing means to compensate for the expansion and contraction of said movable damper means and the consequent movement of said shaft means.

* * * * *